US006786582B2

(12) United States Patent
Kearns et al.

(10) Patent No.: US 6,786,582 B2
(45) Date of Patent: Sep. 7, 2004

(54) METHODS AND SYSTEMS FOR A CONFIGURABLE PRINT CARTRIDGE

(75) Inventors: James P. Kearns, Corvallis, OR (US); Jeffrey T. Hendricks, Camas, WA (US); Kris M. English, Portland, OR (US); Norman E. Pawlowski, Jr., Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/059,887

(22) Filed: Jan. 28, 2002

(65) Prior Publication Data

US 2003/0142179 A1 Jul. 31, 2003

(51) Int. Cl.[7] ..... B41J 2/175
(52) U.S. Cl. ..... 347/86; 347/85
(58) Field of Search ..... 347/85, 86, 87

(56) References Cited

U.S. PATENT DOCUMENTS

| | | | | | |
|---|---|---|---|---|---|
| 4,908,638 | A | * | 3/1990 | Albosta et al. | 347/85 |
| 6,084,617 | A | | 7/2000 | Balazer | |
| 6,145,967 | A | * | 11/2000 | Langford et al. | 347/85 |
| 6,149,267 | A | * | 11/2000 | Geissmann | 347/87 |
| 6,183,076 | B1 | * | 2/2001 | Childers et al. | 347/86 |
| 6,505,923 | B1 | * | 1/2003 | Yamamoto | 347/85 |

FOREIGN PATENT DOCUMENTS

EP 0826504 3/1998

* cited by examiner

*Primary Examiner*—Anh T. N. Vo

(57) ABSTRACT

The described embodiments relate to a print cartridge that can be configured to receive ink from one of at least two possible ink paths depending upon a desired printer configuration. In one exemplary embodiment, the print cartridge has a body configurable to receive ink from at least two different ink supply configurations, and a fluid interface that when coupled with the body effectively selects one of the ink supply configurations.

20 Claims, 9 Drawing Sheets

METHODS AND SYSTEMS FOR A CONFIGURABLE PRINT CARTRIDGE

BACKGROUND OF THE INVENTION

Printing devices have become ubiquitous in society. These devices provide conveniences that were unfathomable only a short time ago. For example, a user, in the privacy of their home, can now take a picture with a digital camera and within seconds have a photo quality print in hand. Consumers very much enjoy this ability and convenience to print images instantaneously and without the hassles of taking film in to be processed. In this context printers and other printing devices have become much more than devices for printing text.

As the technological advances have increased the capabilities of printing devices, consumers demand ever more from the products. Consumers want high quality color printing from a compact machine. In addition to wanting great performance from a printer, consumers want to pay relatively low prices. The ink jet printer has gained wide acceptance in the consumer market because it provides this combination of features. It produces photo-quality color printing while being relatively inexpensive. Even though ink jet printers fulfill many consumer needs, consumers consistently expect gains in printing quality and/or decreased costs.

Accordingly, this invention arose out of concerns associated with providing a printer that satisfies consumer demand while lowering the cost of the product.

SUMMARY OF THE INVENTION

The described embodiments relate to a configurable print cartridge that can be configured to receive ink from one of at least two possible ink paths depending upon a desired printer configuration. In one exemplary embodiment, the print cartridge has a body configurable to receive ink from at least two different ink supply configurations, and a fluid interface that when coupled with the body effectively selects one of the ink supply configurations.

A further embodiment involves a method comprising providing a print cartridge having a print head. The print cartridge has at least two ink supply paths for providing ink to the print head for use in printing. One of the ink supply paths can then be effectively selected.

Another method comprises constructing a print cartridge housing for holding components of the print cartridge. A first ink supply path is formed in the housing for receiving ink from a first ink source for use in a printer. At least one other ink supply path in the housing is formed for receiving ink from a second ink source that is different from the first ink source.

BRIEF DESCRIPTION OF THE DRAWINGS

The same components are used throughout the drawings to reference like features and components.

DETAILED DESCRIPTION OF THE PREFERRED EMBODIMENT

Overview

The various embodiments described below relate to print cartridges for ink jet printers. A print cartridge comprises a portion of the print engine, which is the ink delivery system in a printing device. Ink can be transported from a reservoir or other supply source into the print cartridge. The print cartridge commonly contains a print head where the ink is ejected as droplets onto a print media. The print head can be comprised, for example, of one or more silicon dies and appropriate electrical circuitry. The described embodiments comprise a print cartridge that can be utilized in various print engine configurations by selecting an appropriate ink supply path from at least two possible paths. A fluid interface can be utilized to select one of the paths and exclude alternative paths. This ability can allow multiple printer models to utilize the same print cartridge where the print cartridge is configured to receive ink through a path desirable for a given printer. As a result a product can be delivered to the consumer at less cost while maintaining the qualities that the consumer desires.

The various components described below may not be illustrated accurately as far as their size is concerned. Rather, the included figures are intended as diagrammatic representations to illustrate to the reader various inventive principles that are described herein.

Exemplary Printer System

Figure 1:
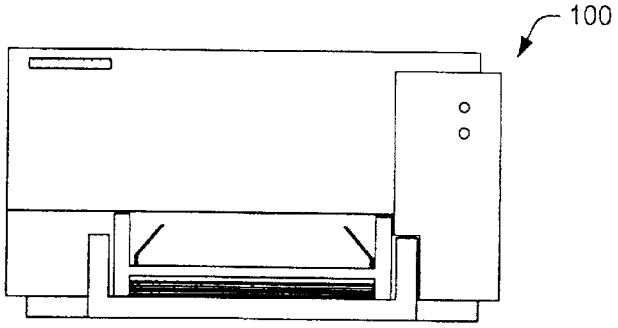
FIG. 1 is a front elevational view of an exemplary device.

FIG. 1 shows a printer 100, embodied in the form of an inkjet printer. The printer 100 can be, but need not be, representative of an inkjet printer series manufactured by the Hewlett-Packard Company under the trademark "Deskjet". The inkjet printer 100 is capable of printing in black-and-white and in color. The term "printer" refers to any type of printer or printing device which ejects ink or other pigmented materials onto a print media. Though an inkjet printer is shown for exemplary purposes, it is noted that aspects of the described embodiments can be implemented in other forms of printing devices that employ inkjet printing elements or other ink ejecting devices, such as facsimile machines, photocopiers, and the like.

Figure 2:
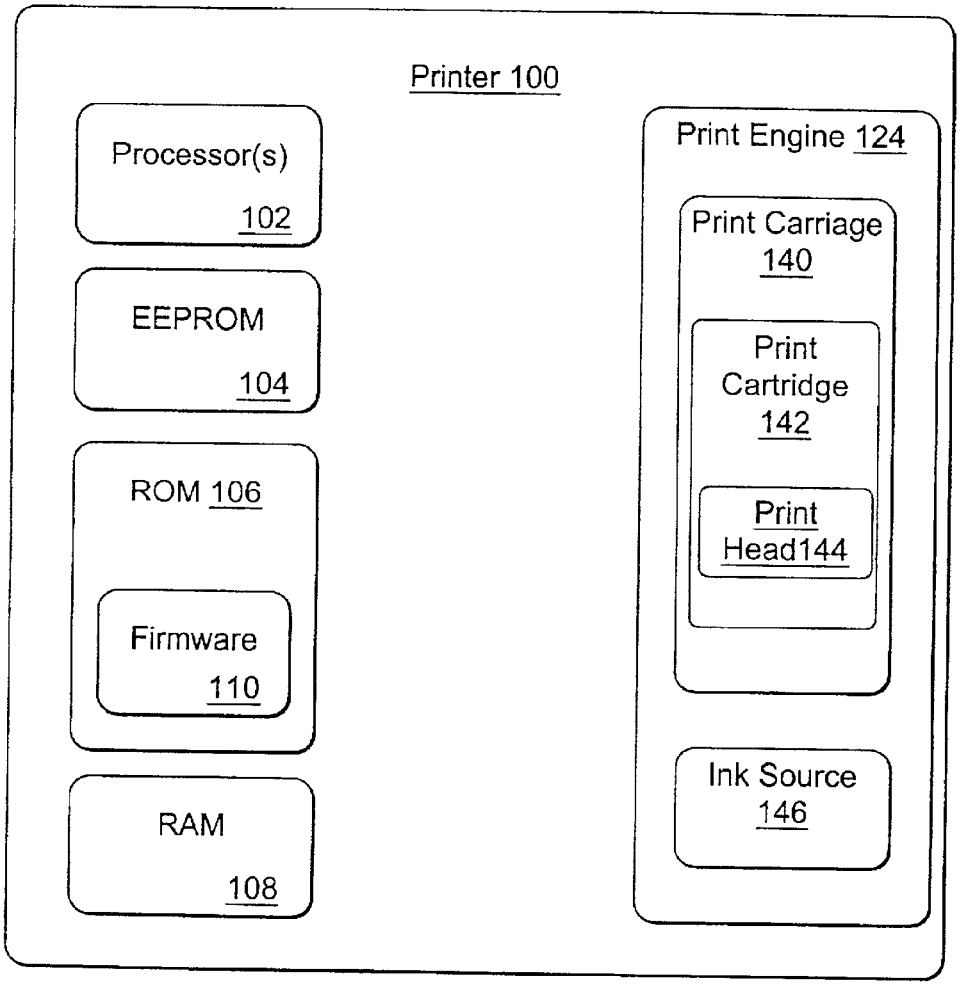
FIG. 2 is a block diagram that illustrates various components of an exemplary electronic device.

FIG. 2 illustrates various components of printer 100 that can be utilized to implement the inventive techniques described herein. Printer 100 can include one or more processors 102. The processor 102 controls various printer operations, such as media handling and carriage movement for linear positioning of the print head over a print media (e.g., paper, transparency, etc.).

Printer 100 can have an electrically erasable programmable read-only memory (EEPROM) 104, ROM 106 (non-erasable), and a random access memory (RAM) 108. Although printer 100 is illustrated having an EEPROM 104 and ROM 106, a particular printer may only include one of the memory components. Additionally, although not shown, a system bus typically connects the various components within the printing device 100.

The printer 100 can also have a firmware component 110 that is implemented as a permanent memory module stored on ROM 106. The firmware 110 is programmed and tested like software, and is distributed with the printer 100. The firmware 110 can be implemented to coordinate operations of the hardware within printer 100 and contains programming constructs used to perform such operations.

Processor(s) 102 process various instructions to control the operation of the printer 100 and to communicate with other electronic and computing devices. The memory components, EEPROM 104, ROM 106, and RAM 108, store various information and/or data such as configuration information, fonts, templates, data being printed, and menu structure information. Although not shown, a particular printer can also include a flash memory device in place of or in addition to EEPROM 104 and ROM 106.

Printer 100 can also include a print engine 124 that includes mechanisms arranged to selectively apply ink (e.g., liquid ink) to a print media such as paper, plastic, fabric, and the like in accordance with print data corresponding to a print job.

The print engine 124 can comprises a print carriage 140, one or more print cartridges 142, and one or more print heads 144 contained in the print cartridges. Additionally, the print engine can comprise one or more ink sources 146 for providing ink to the print cartridges and ultimately to a print media via the print heads.

Exemplary Embodiment

Figure 3:
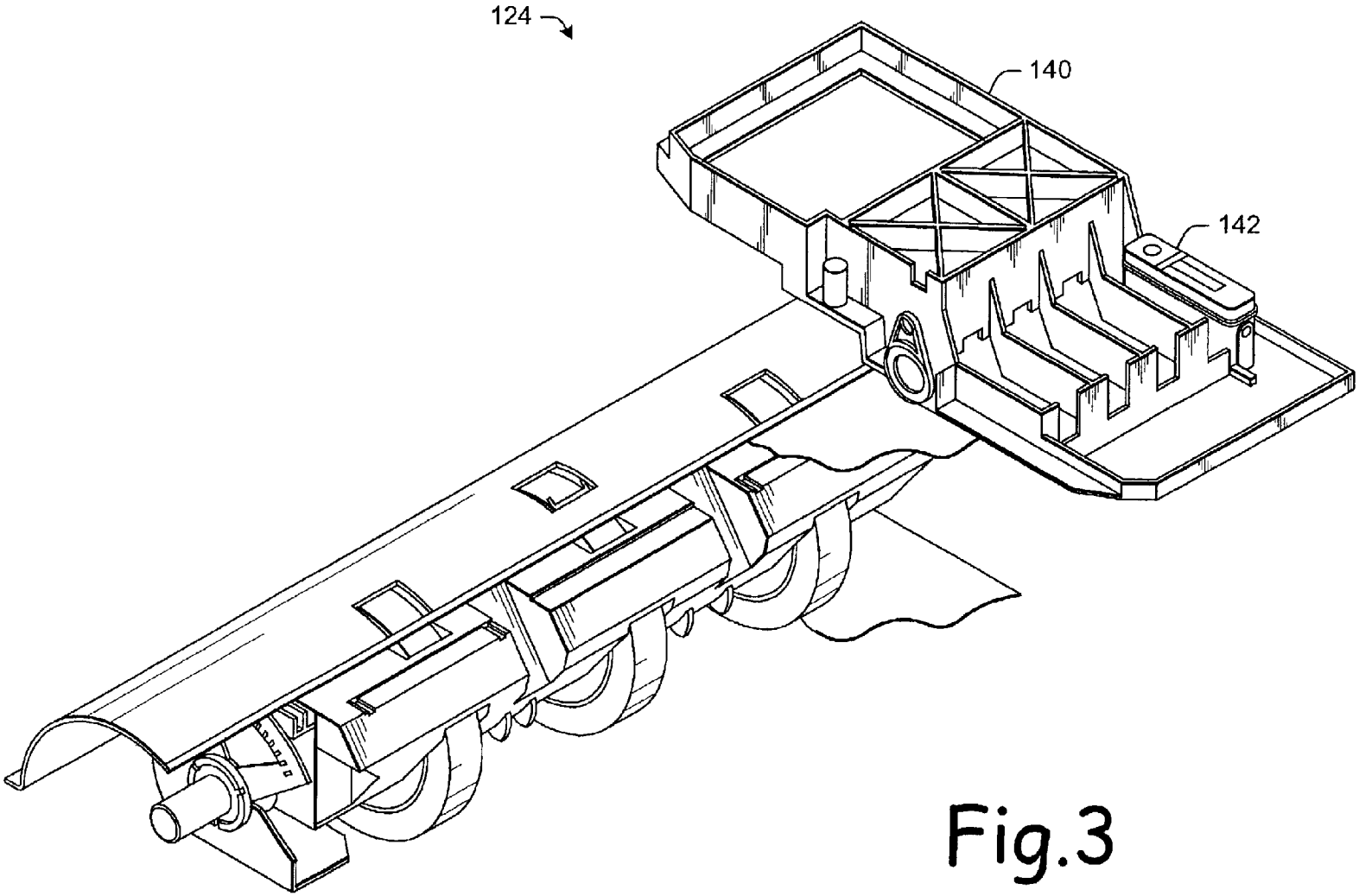
FIG. 3 is an isometric view of portions of a print engine in accordance with one exemplary embodiment.
Figure 5:
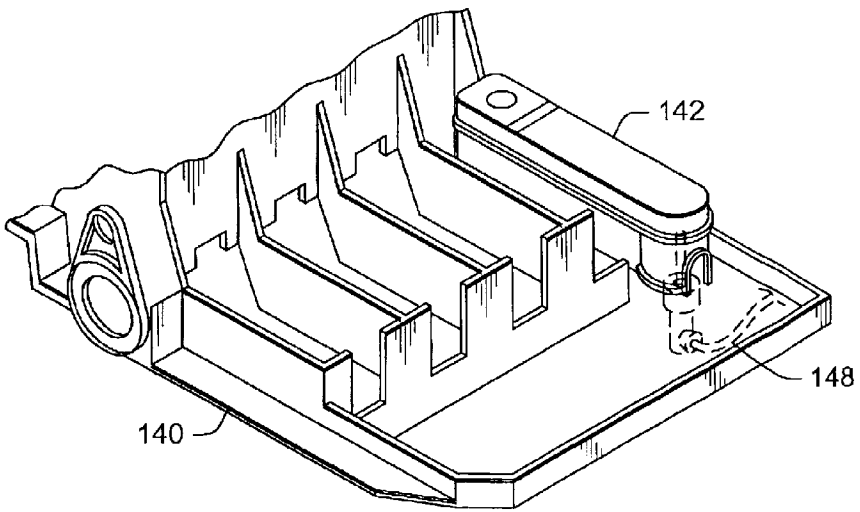
FIG. 5 is an isometric view of portions of a print engine in accordance with one exemplary embodiment.
Figure 4:
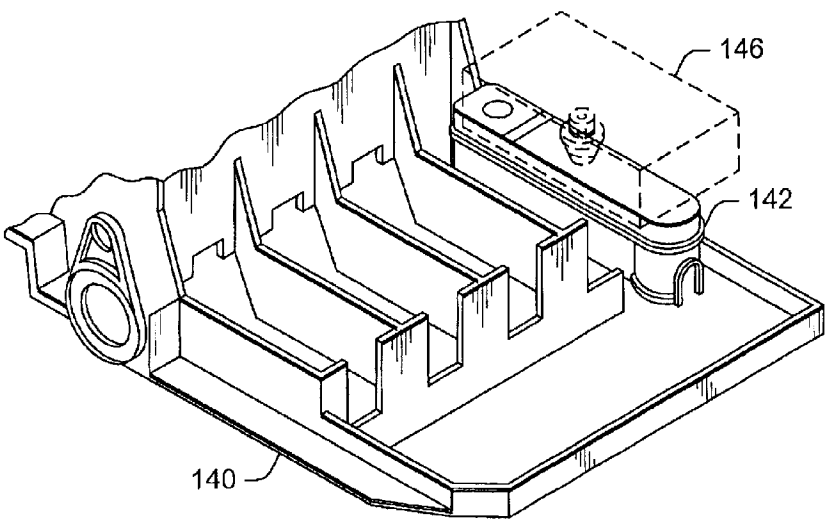
FIG. 4 is an isometric view of portions of a print engine in accordance with one exemplary embodiment.

FIG. 3 is an exemplary embodiment of a portion of a print engine 124 comprising a print cartridge 142 positioned in a print carriage 140. The print cartridge 142 is configurable to receive ink from an ink source and eject ink droplets from a print head 144 (shown FIG. 6) onto a print media (not shown). The print cartridge can be configured to receive ink from a desirable direction or configuration. Ink can be received directly from an ink source 146 or via an ink supply line 148 coupled to the print cartridge. For example, FIG. 4 shows an ink source 146 located above the print cartridge 142 where the print cartridge can be configured to receive ink from above ("up configuration"). In this example, the ink source can feed directly to the print cartridge without the need for an intermediary supply line. Alternatively, FIG. 5 shows an ink supply line 148 that can be connected to the print cartridge from a "down configuration". The ink is received by the print cartridge via the supply line 148 from an ink source 146 (not shown) that can be placed advantageously within or on the printer. The print cartridge can be configured to receive ink from other supply configurations, with the illustrated configurations constituting but examples.

Figures 6, 6A:
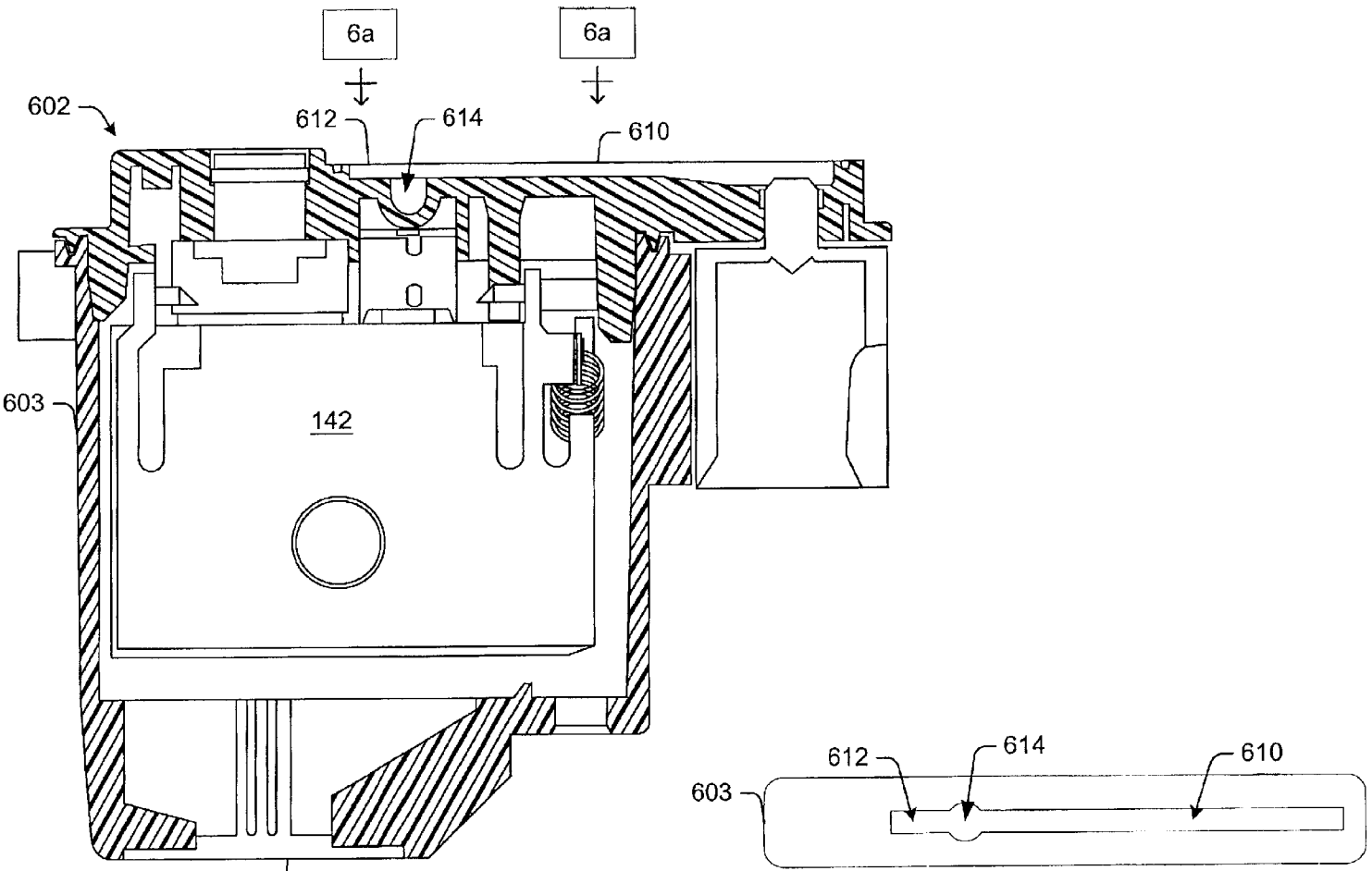
FIG. 6 is a side cross-sectional view of a print cartridge in accordance with one exemplary embodiment.
FIG. 6*a* is a diagrammatic representation in accordance with one exemplary embodiment.

FIG. 6 is a cross-sectional view of a print cartridge 142. The print cartridge can comprise a body 602 and a print head 144. The body can comprise a housing 603 and a fluid interface 606 (shown FIG. 7). The housing 603 can provide structural support for the print head 144. The print head can comprise one or more dies 608.

FIGS. 6–9 show exemplary configurable print cartridges. FIG. 6 shows a first path 610 and a second path 612. These paths can be more easily visualized in FIG. 6*a*. Portions of the first, second and any other paths can be located on or in the body. In this exemplary embodiment, the paths are on the housing 603, and can comprise a groove or channel. The paths can allow the print cartridge to receive ink from an ink source and to transport the ink to passage 614 that allows ink to flow into the internal volume of the print cartridge and ultimately to the print head. Any of these paths when selected can be used to supply ink to the print cartridge for use by the print head. This can be accomplished by securing a fluid interface 606 to the body of the print cartridge. The fluid interface can effectively select and complete one of the paths and prevent leakage of ink from the selected path into a non-selected path or other areas. Examples of how this can be achieved are described below. This ability to select from two or more paths on a print cartridge can allow a single type of configurable print cartridge to be produced in volume and then adapted for use in various printer models.

Figure 7:
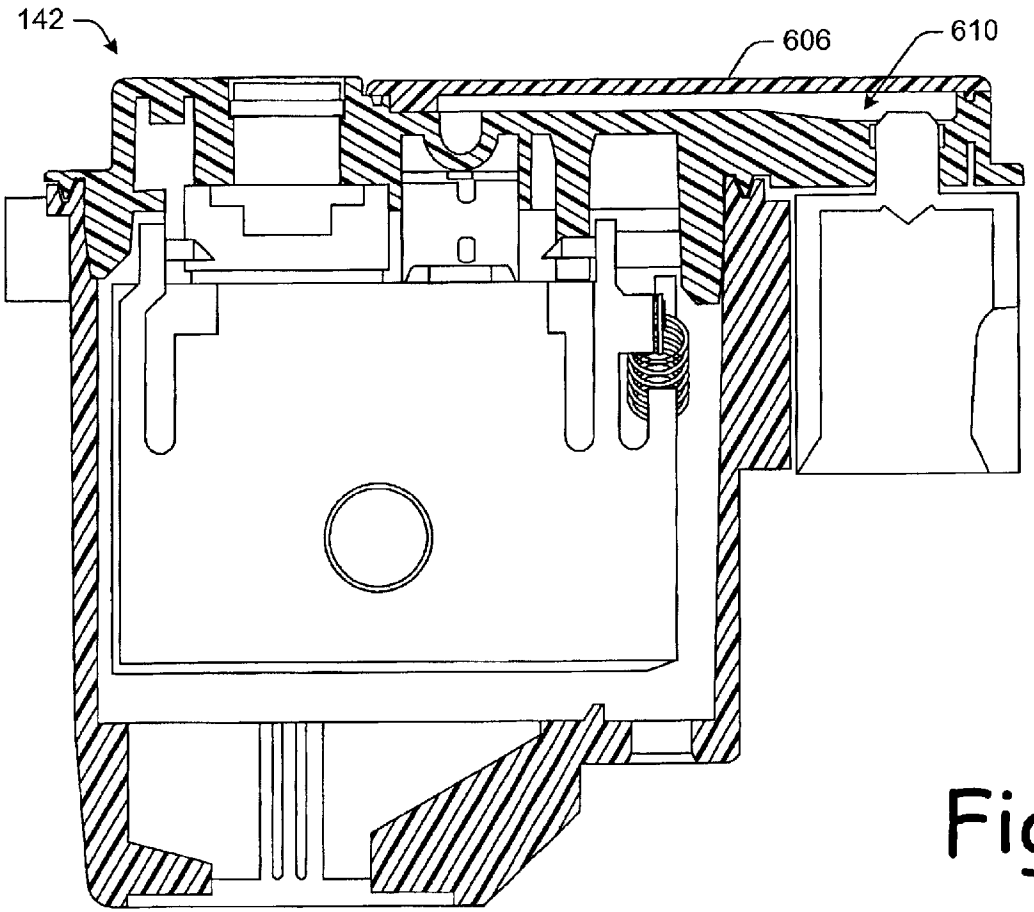
FIG. 7 is a side cross-sectional view of a print cartridge in accordance with one exemplary embodiment.
Figure 8:
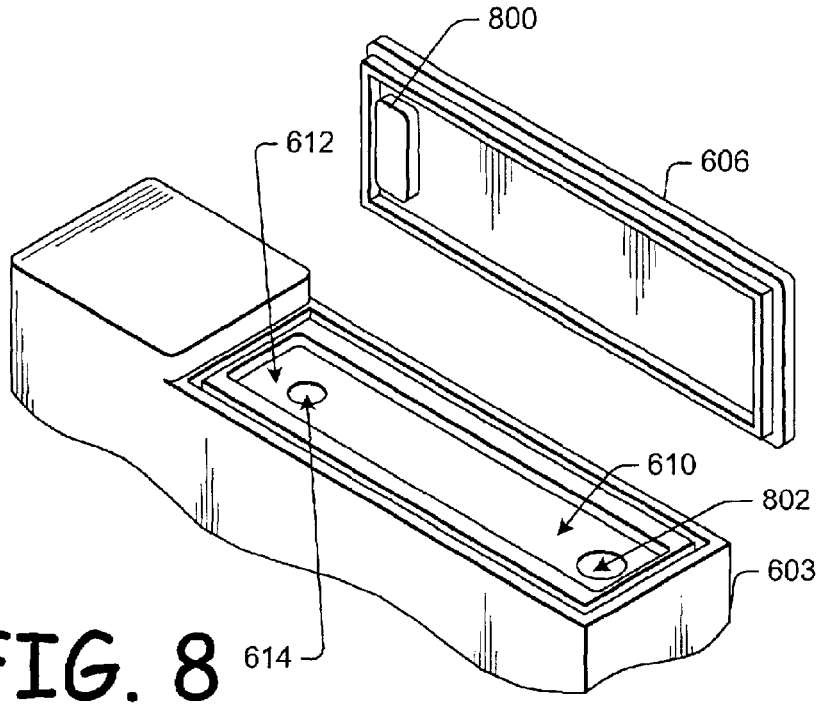
FIG. 8 is an isometric view of portions of a print cartridge in accordance with one exemplary embodiment.
Figure 10:
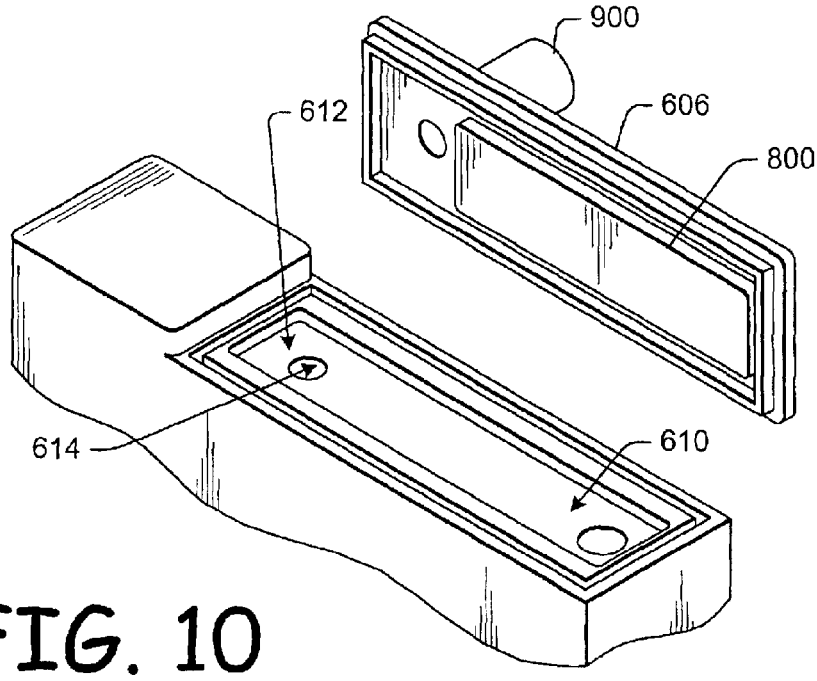
FIG. 10 is an isometric view of portions of a print cartridge in accordance with one exemplary embodiment.
Figure 9:
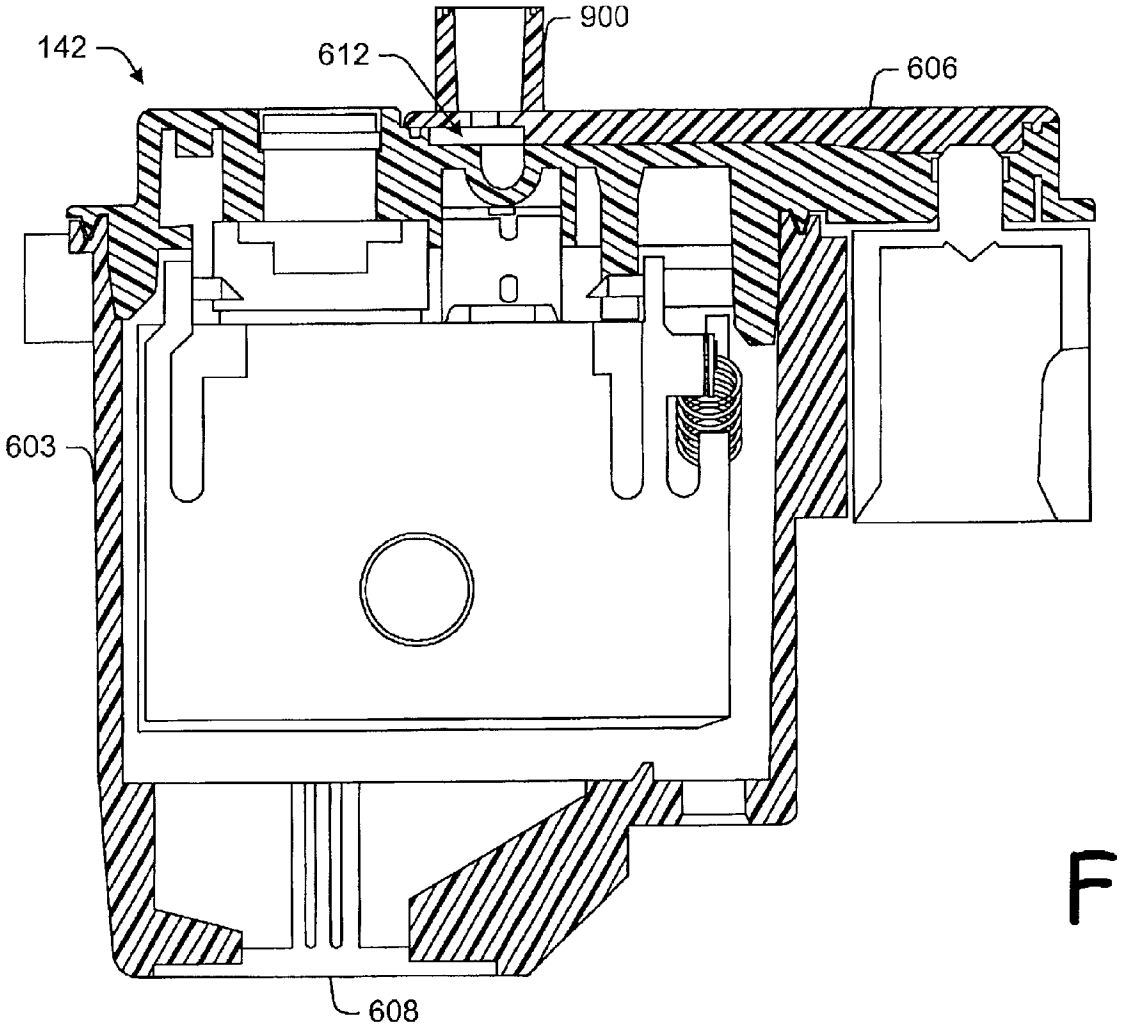
FIG. 9 is a side cross-sectional view of a print cartridge in accordance with one exemplary embodiment.

FIGS. 7 and 9 show the print cartridge 142 with the addition of a fluid interface 606. The fluid interface can effectively select a first path 610 and block a second path 612 and possibly other additional paths (not shown). FIGS. 8 and 10 help to better show the fluid interface 606. FIG. 8 shows how the fluid interface can be configured to select the first path 610 as shown in FIG. 7. Further, FIG. 8 shows how the fluid interface can have a protuberance 800 that effectively blocks a non-selected path. For example, in FIG. 8, protuberance 800 can effectively block the second path 612 and prevent ink from flowing through that path. The protuberance can fill in or block all or a portion of a non-selected path to prevent ink from flowing in that path. This can allow the fluid interface 606 to effectively select a supply path configuration. For example, in FIGS. 7 and 8 ink can pass upward through passage 802 into a first path 610. The first path 610 can be completed by joining the fluid interface with the housing. The ink can flow from the first path into passage 614 and ultimately to the print head 142. The protuberance can block or seal the non-selected second path 612 and prevent ink from flowing into the second path from the first path.

Like FIG. 7, FIG. 9 is cross-section of the print cartridge as depicted in FIG. 6. FIG. 9 shows an exemplary embodiment where the fluid interface 606 can be configured to select a second path 612 and block or exclude a first path 610. FIG. 10 helps to show the relation of the fluid interface and the housing as shown in FIG. 9. FIG. 10 helps to further illustrate how the protuberance 800 of the fluid interface can be configured to block the first path and select the second path. The fluid interface 606 is configured to allow the print cartridge to receive ink through a top or up connect. The fluid interface can be configured to block ink flow through the first channel 610. The fluid interface can allow ink to travel from a supply down through a tower 900 on the ink interface, and through the second channel 612. The ink then can flow downward into the die through passage 614 and ultimately be received by the print head.

For the purposes of clarity, the illustrated embodiments have been shown with only a first path 610 and a second path 612. Other embodiments can have additional paths. In some embodiments, the first and at least some other paths can be completely distinct for their entire length. For example, FIG. 6 shows path 610 and path 612 starting at opposing ends of the body 602 and terminating at passage 614. Thus, the two paths do not share any portion of their length. In other embodiments, the first and second and/or additional paths can share a portion of their length. For example, multiple paths can originate in different places but can merge between their origination points and the print head.

FIGS. 7–10 help to illustrate some of the ways that one path can be selected by the fluid interface. For the ease of explanation these illustrations show the first and second paths to be generally on a portion of the print cartridge opposite the die. In these configurations the fluid interface can comprise a lid. Many other suitable configurations exist and will be recognized by those of skill in the art.

Figure 14:
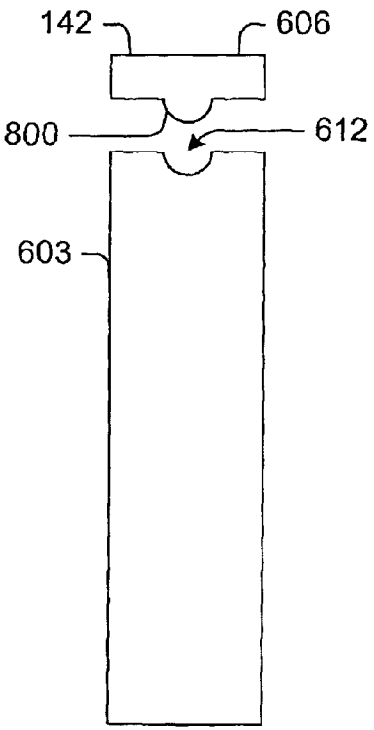
FIG. 14 is a diagrammatic representation of a print cartridge in accordance with one embodiment.
Figure 13:
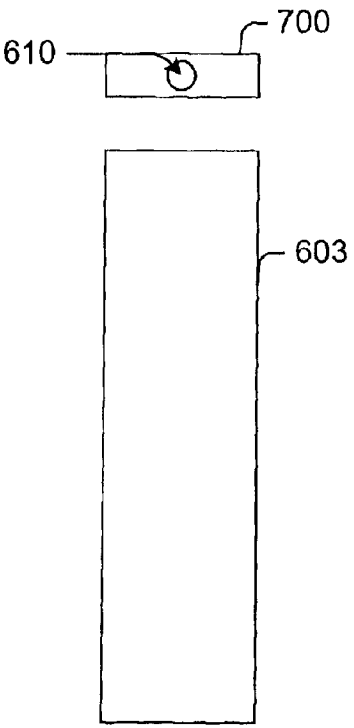
FIG. 13 is a diagrammatic representation of a print cartridge in accordance with one embodiment.
Figure 12:
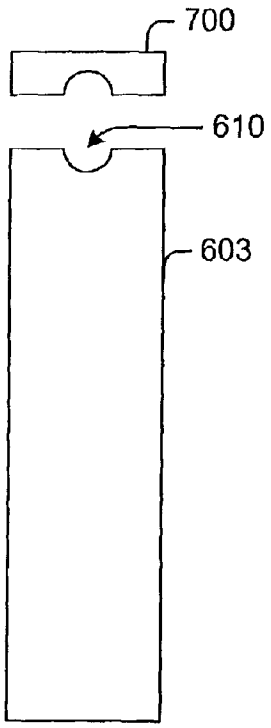
FIG. 12 is a diagrammatic representation of a print cartridge in accordance with one embodiment.
Figure 11:
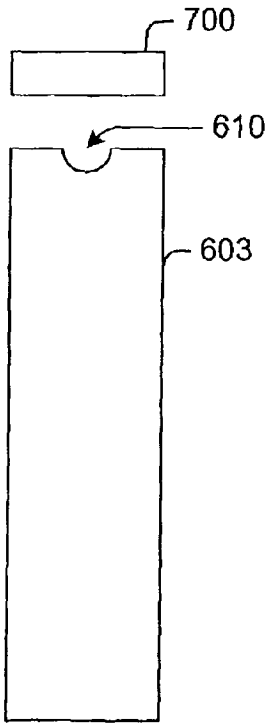
FIG. 11 is a diagrammatic representation of a print cartridge in accordance with one embodiment.

FIGS. 11–14 are cross sections of the housing 603 and a fluid interface 606 that help to illustrate how the fluid interface and the housing can complete a selected path and block or exclude non-selected paths. FIGS. 11–13 show embodiments where the fluid interface and the housing can form an ink passageway from a selected path. Portions of the path can be in the housing and/or portions in the fluid interface or any combination thereof. For example, FIG. 11 shows an exemplary embodiment where a path is entirely in the housing for the shown cross-section. The addition of the fluid interface can complete the path and prevent leakage of supplied ink. FIG. 12 shows a cross-section of a selected path where a portion of the housing comprises a portion of the cross-sectional volume and the fluid interface provides a portion of the cross-sectional volume when the fluid interface is joined with the housing. FIG. 13 shows an embodiment where the entire cross-sectional volume of a path lies within the fluid interface for the point in the length where the cross-section occurs. FIG. 14 shows how the fluid interface can effectively block a non-selected path (in this case 612) with a corresponding protuberance 800.

In the described embodiments, the two or more paths (610 and 612) can originate on different portions of the print cartridge. An ink supply path can be chosen or utilized depending upon various factors including but not limited to the location of an ink source 146, the availability of suitable routing for the ink supply line(s) 148 from the ink source to the print cartridge in a given printer configuration, and ease of access to the ink source.

This flexibility can allow printers to be more efficiently configured since the print cartridge does not limit the placement of the ink source or the routing of any tubes or other structures comprising the ink supply that transport ink from the source to the cartridge. In previous printer designs the print cartridge configuration was fixed. This limited the location of the ink source and the supply path that could be utilized in delivering the ink to the print cartridge. It often prevented a given volume within the printer from being utilized to house an ink source. This often caused printers to occupy a larger volume than would be possible if the source could be ideally positioned. To avoid this problem print cartridges and other parts were often manufactured for a specific printer. This caused increased tooling and manufacturing time as well ultimately increased the price to the consumer. Other previous configurations used print cartridges with wholly self-contained ink sources. This caused decreased capacity and led to increased costs for the consumer because the entire print cartridge had to be replaced when it ran out of ink. Thus, the consumer ended up paying for new electronics and other components when they simply needed more ink.

The embodiments described herein allow a streamlining of parts that are required for a printer. Additionally, the cost of research and development for the configurable part can be shared by multiple product lines resulting in higher performance at less cost for the consumer.

The described components can be constructed in any suitable way from any suitable materials. The body can comprise plastic, polyester, and/or other suitable polymers such as polyphenylene sulfide. Various parts of the print cartridge 142 can be constructed separately and then assembled or they can be constructed together. For example, portions of the housing can be formed through injection molding a thermoplastic into an appropriately shaped mold. The various portions can be assembled using a suitable technique such as ultrasonic welding.

The fluid interface 606 can be constructed from a material such as plastic, or other suitable polymers. The fluid interface can be constructed in any appropriate manner, such as injection molding. The protuberance can be made from the same material as the rest of the fluid interface or can be made from a different material. A deformable material such as silicone can aid in sealing the fluid interface with the housing. A combination of materials can also be used. For example, one or more protuberances as needed for a given selected configuration can be molded as part of the fluid interface and then silicon or other sealant can be applied between the fluid interface and the housing. In some embodiments the fluid interface can comprise a tube or tubes that complete a selected path at the exclusion of one or more non-selected paths.

First Exemplary Method

Figure 15:
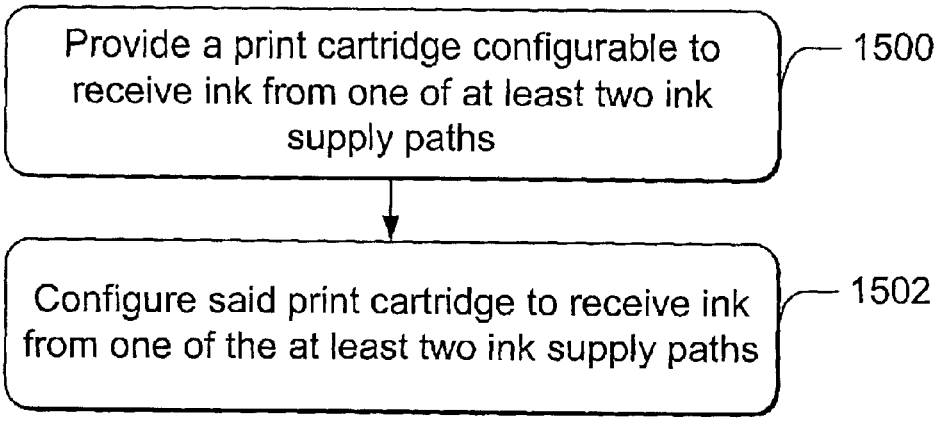
FIG. 15 is a flow chart showing steps in a method in accordance with one exemplary embodiment.

FIG. 15 describes steps in a method in accordance with one exemplary embodiment. Step 1500 provides a print cartridge configurable to receive ink from one of at least two paths. In one exemplary embodiment, this can be achieved by constructing a print cartridge housing for holding components of the print cartridge. The housing can be constructed using any suitable method. For example, a suitable type of flowable plastic or other polymer can be injected into a mold and subjected to conditions that make the material generally rigid or non-flowing. This can be accomplished using thermoplastics or other injectable plastics.

Portions of the housing can be constructed separately and coupled through any suitable process such as sonic welding, or with adhesives, to name just a few processes. Ink supply paths can be formed in the housing. Some of the ink supply paths can be configured to receive ink from a first ink source for use in a printer, while others can receive ink from a second and/or subsequent ink sources. The ink supply paths can be formed contemporaneously with the molding process. For example, an appropriate corresponding shape can be included in the mold to form a first supply path. Alternatively, the supply paths can be formed by removing material from the formed body or by adding fluid handling structures after the molding process. The ink supply paths can be formed contemporaneously with each other or can be formed at different times and/or by different processes. The paths, or portions of the length of the paths, can be located in the body and/or fluid interface, or other appropriate structures.

Step 1502 configures the print cartridge to receive ink from one of the paths formed in step 1500. This can be accomplished by coupling a fluid interface with a selected path in a manner that effectively blocks one of more non-selected paths. In some exemplary embodiments the paths can be located in the body of the cartridge and coupling the fluid interface can effectively select a path at the exclusion of other non-selected paths. This can be achieved, among other ways, by locating protuberances or by otherwise blocking a non-selected path so that when the fluid interface is coupled to the body the non-selected paths are effectively blocked from delivering ink to the print head. Blocking can entail preventing leakage from a selected path into non-selected paths. For example, in embodiments where a selected path and a non selected path do not share any of there length, blocking can entail blocking ink from leaking from the print cartridge via the non-selected path(s).

CONCLUSION

The described embodiments relate to a print cartridge that can be utilized in various print engine configurations by selecting an appropriate ink supply path from at least two possible paths. A fluid interface can be utilized to select one of the paths and exclude alternative paths. This ability can allow multiple printer models to utilize the same print cartridge where the printer cartridge is configured to receive ink through a path desirable for a given printer.

What is claimed is:

1. A print cartridge for use in an inkjet printer, comprising:

a housing for supporting a print head;

a first ink receiving path supported by the housing, and configured to supply ink to said print cartridge;

at least one other different ink receiving path supported by the housing, and configured to supply ink to said print cartridge; and a fluid interface secured to the housing and completing the first ink supply path and blocking the second ink supply path.

2. The print cartridge of claim 1, wherein at least a portion of said first and said at least one other pathway is located within said housing.

3. The print cartridge of claim 1, wherein said housing is comprised of plastic.

4. The print cartridge of claim 3, wherein said plastic comprises a thermoplastic.

5. A print cartridge comprising:

a print head for ejecting ink droplets;

a first supply path on the print cartridge for supplying ink to the print head from a first ink source associated with a first printer configuration where the first ink source is located above the print cartridge; and at least one other different supply path on the print cartridge for supplying ink to the print head from a second ink source associated with a second printer configuration where the second ink source is not located above the print cartridge.

6. The print cartridge of claim 5, wherein the print cartridge comprises a housing that is configured to receive a fluid interface that effectively selects one of the supply paths.

7. The print cartridge of claim 6, wherein the fluid interface comprises a lid that effectively selects one of the supply paths for receiving ink.

8. A method comprising:

constructing a print cartridge configured to support a print head;

forming a first ink supply path in the housing for receiving ink from a first ink source for use in a printer;

forming at least one other ink supply path in the housing for receiving ink from a second ink source that is different from the first ink source; and, securing a component to the housing to complete an individual ink supply path and to block at least a different ink supply path.

9. The method of claim 8, wherein said constructing a print cartridge housing comprises constructing a print cartridge housing using injection molding.

10. The method of claim 8, wherein said forming said first ink supply path and forming said at least one other ink supply path occur contemporaneously.

11. The method of claim 8, wherein said constructing a print cartridge housing comprises constructing a print cartridge housing by injection molding material to contemporaneously form at least one of said supply paths.

12. A print cartridge comprising:

a body configurable to receive ink from a first ink supply configuration and at least a second ink supply configuration; and a fluid interface that when coupled with the body effectively selects one of the ink supply configurations such that the print cartridge is not configured to be changed to a different ink supply configuration when installed in a printing device.

13. A print cartridge comprising:

a print head and a body connected with the print head, the body being configurable to receive ink from a first ink supply configuration at least a portion of which is configured for ink to flow in a first direction, the body being further configurable to receive ink from at least a second ink supply configuration at least a portion of which is configured for ink to flow in a second generally opposite direction.

14. A method, comprising:

configuring a print cartridge to receive ink from a selected ink supply path, the selected ink supply path comprising one of a first ink supply path of the print cartridge and a second different ink supply path of the print cartridge, wherein said configuring produces the print cartridge that is not intended to be subsequently reconfigured to receive ink from other than the selected ink supply path.

15. A method, comprising:

molding a first channel comprising a portion of a first ink path into a print cartridge housing; and, molding a second different channel comprising a portion of a second different ink path into the print cartridge housing such that only one of the first and second channels will be utilized at the exclusion of the other of the first and second channels.

16. The method of claim 15 further comprising positioning a molded fluid interface against the print cartridge housing to allow ink to be received into an internal volume of the housing along one of the first ink path and the second ink path and to block the other of the first ink path and the second ink path.

17. A print cartridge, comprising:

a first molded portion having at least a portion of a first ink feed passageway molded thereon and at least a portion of a second different ink feed passageway molded thereon; and, a second molded portion configured to be secured to the first molded portion to complete one of the first ink feed passageway and the second different ink feed passageway and to block the other of the first ink feed passageway and the second different ink feed passageway.

18. The print cartridge of claim 17, wherein the first molded portion comprises a cartridge body and the second molded portion comprises a fluid interface.

19. A print cartridge comprising:

a housing having a portion of a first ink supply path and a portion of a second different ink supply path molded thereon; and, an interface structure secured to the housing and configured to complete the first ink supply path and block the second ink supply path.

20. A print cartridge comprising:

a first component comprising a first portion of a first ink supply path on the print cartridge and a first portion of a second different ink supply path on the print cartridge; and, a second component secured to the first component, the second component comprising a second portion of the first ink supply path and the second component further comprising a structure configured to block the second ink supply path on the print cartridge.

* * * * *